US005904835A

United States Patent [19]

Thakkar

[11] Patent Number: 5,904,835

[45] Date of Patent: May 18, 1999

[54] DUAL FEED REACTOR HYDROCRACKING PROCESS

[75] Inventor: Vasant P. Thakkar, Elk Grove Village, Ill.

[73] Assignee: UOP LLC, Des Plaines, Ill.

[21] Appl. No.: 08/957,087

[22] Filed: Oct. 24, 1997

Related U.S. Application Data

[60] Provisional application No. 60/033,841, Dec. 23, 1996.

[51] Int. Cl.[6] ..... C10G 51/06

[52] U.S. Cl. ..... 208/78; 208/80

[58] Field of Search ..... 208/78, 97, 80

[56] References Cited

U.S. PATENT DOCUMENTS

| | | | |
|---|---|---|---|
| 3,047,490 | 7/1962 | Myers | 208/59 |
| 3,089,843 | 5/1963 | Eastman et al. | 208/58 |
| 3,338,819 | 8/1967 | Wood | 208/97 |
| 3,429,801 | 2/1969 | Gleim et al. | 208/58 |
| 3,579,435 | 5/1971 | Olenzak et al. | 208/59 |
| 4,082,647 | 4/1978 | Hutchings et al. | 208/78 |
| 4,197,184 | 4/1980 | Munro et al. | 208/89 |
| 4,713,167 | 12/1987 | Reno et al. | 208/59 |
| 4,859,309 | 8/1989 | De Vries et al. | 208/61 |
| 5,403,469 | 4/1995 | Vauk et al. | 208/78 |
| 5,595,634 | 1/1997 | Hearn et al. | 203/29 |

OTHER PUBLICATIONS

Scherzer Julius and A.J. Gruia, *Hydrocracking Science and Technology*, copyright 1996 by Marcel Dekker, Inc., pp. 174–187.

*Primary Examiner*—Walter D. Griffin
*Assistant Examiner*—Tam M. Nguyen
*Attorney, Agent, or Firm*—Thomas K. McBride; John F. Spears, Jr.

[57] ABSTRACT

A large hydrocracking feed stream is processed without resorting to full dual reaction trains by passing a portion of the feed stream into each of two reaction zones, with the effluents of the two reaction zones being charged into a common separation and product recovery facility. Unconverted hydrocarbons recovered in the product recovery facility are passed into only one of the reaction zones.

9 Claims, 1 Drawing Sheet

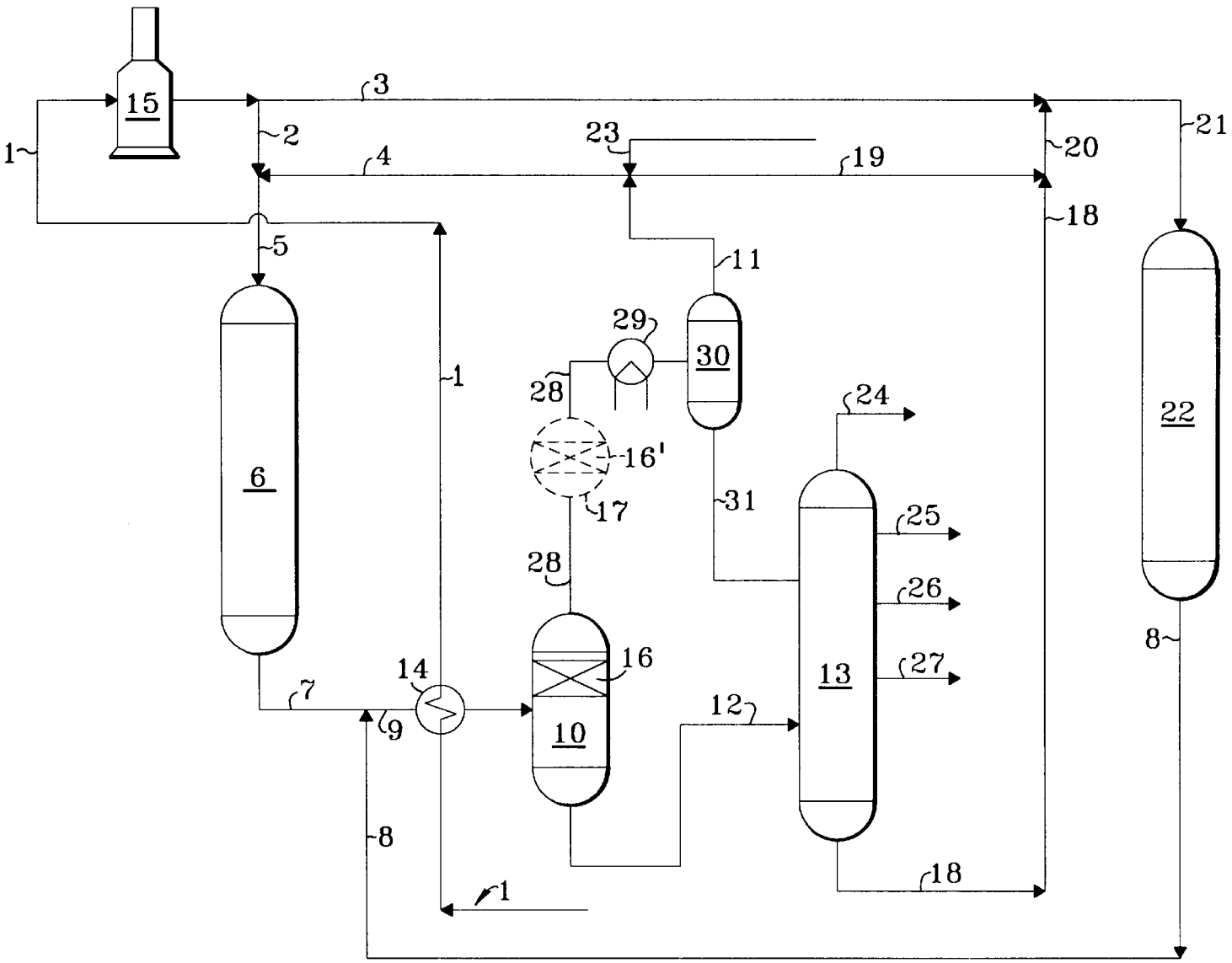
21
22
8
20
18
19
25
26
27
24
13
18
11
30
31
12
29
16'
17
16
10
23
28
28
1
1
14
9
8
3
4
2
5
6
7
15
1

DUAL FEED REACTOR HYDROCRACKING PROCESS

This application is related to and claims the benefit of the filing date of provisional application 60/033,841 filed Dec. 23, 1996.

FIELD OF THE INVENTION

The invention relates to a hydrocarbon conversion process for use in petroleum refineries. The invention more specifically relates to a novel flow scheme for a hydrocracking process.

RELATED ART

Hydrocracking processes are used commercially in a large number of petroleum refineries. They are used to process a variety of feeds ranging from naphthas to very heavy crude oil residual fractions. In general the hydrocracking process splits the molecules of the feed into smaller (lighter) molecules having higher average volatility and economic value. At the same time a hydrocracking process normally improves the quality of the material being processed by increasing the hydrogen to carbon ratio of the materials, and by removing sulfur and nitrogen. The significant economic utility of the hydrocracking process has resulted in a large amount of developmental effort being devoted to the improvement of the process and to the development of better catalysts for use in the process. A general review and classification of the different hydrocracking process flow schemes is provided in the book entitled, *"Hydrocracking Science and Technology",* authored by Julius Scherzer and A. J. Gruia, published in 1996 by Marcel Dekker, Inc. Specific reference may be made to the chapter beginning at page 174 which describes single stage, once-through and two-stage hydrocracking process flow schemes.

A number of references illustrate the use of multiple hydrocracking zones within an overall hydrocracking unit. The terminology "hydrocracking zones" is employed herein as hydrocracking units often contain several individual reactors. U.S. Pat. No. 3,579,435 issued to A. T. Olenzach et al. illustrates a process in which three different feedstreams are fed to an overall process. Each of the feedstreams is fed into a different hydrocracking zone. The effluent of a first zone flows into the second zone and the effluent of the second zone flows into the third zone. The effluent of the third zone is passed into the product recovery section.

U.S. Pat. No. 3,047,490 issued to J. W. Myers illustrates a two-stage hydrocracking process with the feed entering a first hydrocracking zone, and heavy material separated from the effluent of the first zone being passed into a second hydrocracking zone. U.S. Pat. No. 4,197,184 issued to W. H. Munro et al. illustrates a more complete flow of a hydrocracking process. The feed stream is passed into a first hydrocracking zone, with the effluent of this zone being passed into a separation and product recovery section. The unconverted material recovered from a fractionation column in the recovery section is charged to a second hydrocracking zone and the effluent of this hydrocracking zone is passed into the same separation and product recovery zone.

U.S. Pat. No. No. 4,713,167 issued to M. E. Reno et al. illustrates yet another process flow variation for a hydrocracking unit. In this flow described as a multiple single stage process, the feedstream passes through a first hydrocracking zone and then enters the separation and product recovery section. Unconverted material from the product recovery column is passed back to the first hydrocracking zone. A portion of a heavy distillate stream removed from near the bottom of the product recovery column is passed into a second hydrocracking zone, with the effluent of this hydrocracking zone being passed into the separation and product recovery column.

A two-stage process for processing asphalt-containing chargestocks is illustrated in U.S. Pat. No. 3,429,801 issued to W. K. T. Gleim et al. In this process a first chargestock is passed into the first reaction zone, with the effluent of this zone being passed into a product recovery column. The unconverted material from this first product recovery material together with a second chargestock is passed into a second hydrocracking zone which produces an effluent sent to a second product recovery column. The bottom stream from the second product recovery column is passed into the first hydrocracking zone.

It is known in the art that hydrogen sulfide present in the effluent of a hydrocracking reactor will combine with olefinic hydrocarbons to form "recombinant" mercaptans. One solution to this problem is the provision of a separate bed of hydrotreating catalyst located at the bottom of the hydrocracking reactor as shown in U.S. Pat. No. 3,338,819 issued to F. C. Wood.

BRIEF SUMMARY OF THE INVENTION

The invention is a single-stage hydrocracking process which allows for increased feedstream charge rates without resorting to a "dual train" processing scheme which employs duplicate heat exchangers, separation vessels, etc. In the subject process the feedstream is split between two single-stage reaction zones operated in parallel with the entire effluent of both reaction zones being passed into a common separation and recovery section. All of the "unconverted" material recovered from the recovery section is recycled into only one of the hydrocracking zones. The subject process results in a cost reduction compared to the construction of two separate processing trains and also provides certain operational advantages. It is one characteristic of the process that each reactor is operated to achieve from about 40 to about 85 volume percent conversion of the entering hydrocarbons.

One broad embodiment of the invention may be characterized as a process which comprises the steps of: dividing a hydrocarbon feed stream into a first feed stream and a second feed stream, and contacting the first feed stream and hydrogen with a first bed of hydrocracking catalyst maintained at hydrocracking conditions in a first hydrocracking reaction zone; contacting the second feed stream, in admixture with hydrogen, with a second bed of hydrocracking catalyst maintained at hydrocracking conditions in a second hydrocracking reaction zone; passing the effluent of the first hydrocracking reaction zone and the effluent of the second hydrocracking reaction zone into a vapor-liquid separation zone, and removing a vapor phase process stream and a liquid phase process stream from the vapor-liquid separation zone; recycling at least a hydrogen-rich portion of the vapor phase process steam to each of the first and second hydrocracking reaction zones; passing the liquid phase process stream into a fractionation zone, and recovering a distillate boiling range product stream and a hydrocarbon recycle stream comprising unconverted hydrocarbons; and, passing the hydrocarbon recycle stream into the second hydrocracking reaction zone.

BRIEF DESCRIPTION OF THE DRAWING

The Drawing illustrates a hydrocracking process in which separate portions of the process feedstream of line 1 are passed into hydrocracking reactor 6 and hydrocracking reactor 22, with the entire recycle stream of unconverted chargestock carried by line 18 being passed into reactor 22.

DETAILED DESCRIPTION AND PREFERRED EMBODIMENTS

Both new hydrocracking units and units being upgraded are tending to be larger in size as measured by the flow rate of the feed stream. As the minimum required cross-sectional area of a reactor is set on the basis of mass flux in terms of weight of feed/unit area/hour, an increase in flow rate results in the need for a larger cross section reactor. At about 60,000 barrels of feed per stream day (BPSD) and with a recycle gas rate of about 10,000 std. cubic/barrel (SCFB), the required vessel diameter reaches about 19–20 feet. This is approaching the current upper limit of the diameter for high pressure vessel fabrication and transportation to refineries. These one piece thick-walled, e.g., 12–20 inch thick, steel vessels are major cost components of a hydrocracking process unit. They are extremely heavy and this plus the transportation problem are design limitations. A feed rate above about 60,000 BPSD normally results in the need to use two separate reactors and reactor trains. As used herein a "reactor train" is considered to include the fired heater upstream of the reactor plus the heat exchangers and separation vessels between the reactor and the downstream product transportation column.

A separate situation in which the size of available reactors is a limitation on the process design occurs when, due to the high cost of fabricating and transporting the reactors, it is desired to reuse existing reactors while revamping the unit to an increased design feed rate.

It is an objective of the subject invention to provide a recycle hydrocracking process for processing very large feed stream flow rates. It is a specific objective of the invention to provide a hydrocracking process having only a single "train" of equipment downstream of the reaction zone. It is a further objective to provide a hydrocracking process flow which allows processing at a relatively high feed rate in a revamped unit which employs existing reactors.

These objectives are met through the use of a unique flow scheme in which the feed stream is split into two portions, with each portion being passed directly into a separate reaction zone. A recycle stream of unconverted feed removed from a product recovery column is also passed into one of the reaction zones. The subject process is therefore distinguished by this division of a single feed stream into two smaller streams of identical composition which are passed into separate reaction zones. No hydrocarbon removed from one of the reaction zones is passed into the other reaction zone without having first passed through the effluent separation and product recovery facilities. All of the feed is passed into the initial reactors of the reaction zones, thus distinguishing it from flow schemes having sequential addition of feed at different points in the reaction zone.

Both of the reaction zones employed in the subject process must operate with a significant level of conversion of entering feed components into distillate products. The term "conversion" as used herein therefore refers to the chemical change necessary to allow the product hydrocarbons to be removed in one of the product streams of the process withdrawn from the product recovery zone. This definition provides for the inherent variation in feeds and desired products which exists between different refineries. Typically, this definition will require the production of hydrocarbons having a boiling point below about 700° F. (371° C.). Each reaction zone should be designed and operated to achieve at least a 40 volume percent conversion of feed compounds boiling above the maximum desired product boiling point. Preferably, the conversion level in each reaction zone is above 50 percent and more preferably the conversion level is above 60 percent. The conversion level should be in the general range of from about 40 to about 85 percent.

In a representative example of a conventional hydrocracking process, a heavy gas oil would be charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, reaction by-products such as hydrogen sulfide and ammonia formed by hydrodesulfurization and hydrodenitrification reactions which occur simultaneously with the hydrocracking reaction. The reaction zone effluent will also contain the desired product hydrocarbons boiling in the gasoline, diesel fuel, kerosene or fuel oil boiling point ranges and some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone and then passed into a vapor-liquid separation zone normally referred to as a high pressure separator. Additional cooling can be done prior to this separation. In some instances a hot flash separator is used upstream of the high pressure separator. The use of "cold" separators to remove condensate from vapor removed from a hot separator is another option. The liquids recovered in these vapor-liquid separation zones are passed into a product recovery zone containing one or more fractionation columns. Product recovery methods for hydrocracking are well known and conventional methods may be employed. In many instances the conversion achieved in the hydrocracking reactor(s) is not complete and some heavy hydrocarbons are removed from the product recovery zone as a "drag stream" which is removed from the process and/or as a recycle stream. The recycle stream is preferably passed into the hydrotreating (first) reactor in a hydrotreating-hydrocracking sequence as this reduces the capital cost of the overall unit. It may, however, sometimes be passed directly into a hydrocracking reactor.

A "hot" high pressure separator is distinguished in the art from a "cold" high pressure separator by the fact that the process stream entering a cold separator has been cooled by indirect heat exchange against an external coolant stream such as air or cooling water. This is in contrast to some cooling upstream of a hot separator performed to recover heat for reuse in the process. The term "high pressure" separator indicates the separator is operated at essentially the operating pressure of the upstream reaction zone minus any inherent pressure drop due to intermediate lines and vessels. Reference may be made to the previously cited text *Hydrocracking Science and Technology* for further information on general hydrocracking process flows.

Referring now to the Drawing, a process feedstream which can contain any of the materials enumerated herein enters the process through line 1 and is heated by indirect heat exchange in exchanger 14. It is then passed into the fired feed heater 15 and is then divided between lines 2 and lines 3. The portion flowing through line 2 is admixed with recycle hydrogen from line 4 and passed as a first feed stream through line 5 into a first hydrocracking zone 6, which can comprise two or more individual reactors. In the reaction zone 6 the entering chargestock and hydrogen are contacted with a suitable hydrocracking catalyst maintained at hydrocracking conditions which affect the conversion of a sizable fraction of the entering hydrocarbonaceous compounds into lower boiling point compounds. The cracking reactions result in the formation of a large variety of different compounds having different molecular weights ranging from methane up to compounds within the boiling point range of the feedstream. Besides this conversion of charge molecules to lower boiling molecules, the reactions within the hydrocracking reactor result in the removal of sulfur and nitrogen from the entering feed and the production of hydrogen sulfide and ammonia. There is thereby produced a reaction zone effluent stream which is removed from hydrocracking reaction zone 6 through line 7. This stream is admixed with an effluent stream of the second reaction zone carried by line 8 and then passed through line 9 into the heat exchanger 14 and then into a vapor-liquid separation zone 10.

For the purpose of clarity of presentation, such normal and customary equipment as control valves, sensors, additional separation vessels, the quench streams to the midpoints of hydrocracking reaction zones and other required systems are not illustrated on the Drawing. Another feature not shown is the equipment associated with water injection and aqueous phase collection and removal for the control of salt formation.

While not shown on the drawing, it is within the scope of the invention for the one or more reactors of each reaction zone to contain some hydrotreating catalyst. A pretreatment for the removal of sulfur and nitrogen from the chargestock is sometimes desired upstream of a bed of hydrocracking catalyst. Likewise a small bed of hydrotreating catalyst may be desired as the last catalyst in the reaction zone to reduce the mercaptan content of recovered products. Rather than placing the hydrotreating catalyst in a hydrocracking reactor, it is preferred to employ one of the alternative embodiments shown in the drawing in which this post treating catalyst is located downstream of the initial separation of the reaction zones' effluent into vapor and liquid streams. These embodiments locate the post treating catalyst upstream of any cold separator employed in the process.

The separation zone 10 concentrates the hydrogen present in the reaction zone effluent stream of line 9 into a vapor phase stream carried by line 28. The vapor-phase stream of line 28 is passed through an indirect heat exchange means 29 which provides cooling adequate to condense some additional hydrocarbons. The contents of line 28 is then separated in a second separator 30, which produces the hydrogen recycle stream of line 11. This stream may be passed through a hydrogen sulfide removal zone not shown on the Drawing. Makeup hydrogen from line 23 is admixed into the recycle gas stream of line 11 and it is divided into the separate recycle gas streams of lines 4 and 19.

The liquid phase hydrocarbons recovered in the vapor-liquid separators 10 and 30 are passed through lines 12 and 31 respectively into a product recovery fractionation column 13. The fractionation column 13 is designed and operated to separate the entering hydrocarbons based upon their relative volatility into a number of different product streams and a recycle stream. The lightest stream removed from the fractionation column 13 comprises the overhead stream of line 24 which will normally comprise methane through butane with some small amounts of other compounds. Also removed from this column will be a stream of naphtha boiling range hydrocarbons carried by line 25, and one or more heavier distillate product streams removed through line 26 and 27 which may be kerosene or diesel fuel boiling range product streams. There is also recovered from the bottom of the fractionation column a stream of unconverted hydrocarbons removed through line 18. A small portion of this bottoms stream could be removed as a "drag" stream not shown on the drawing. This is more likely as the feed becomes heavier.

As previously referred to, "post treating" by contacting the lighter portion of the hydrocracking reaction zone effluent is preferably performed between the initial separation of the effluent and its cooling to the temperature of a cold separator. This can be performed in an upper portion of the high pressure separator 10 using a small bed of hydrotreating catalyst 16. Alternatively a small reactor, such as the optional spherical reactor 17 containing a catalyst bed 16' could be used to perform this post treating. A location downstream of a heat exchanger 14 is beneficial as the desired hydrotreating reactions are normally favored by temperatures lower than the temperature of the hydrocracking catalyst effluent.

While being referred to as "unconverted hydrocarbons", the hydrocarbons of line 18 have been passed through at least one of the hydrocracking zones employed in the process, and therefore have different overall characteristics than the feed stream. It may have a reduced content of sulfur and nitrogen compared to the feed stream but will on average be slightly "harder" to crack than the feedstream as a result of the remaining unconverted hydrocarbons being richer in cyclic paraffins than the feed. This stream of unconverted material carried by line 18 is combined with the hydrogen-rich gas stream of line 19 and passed through line 20 to the junction with line 3. At this point it is admixed with the second portion of the feedstream. The admixture of feedstream, recycled unconverted hydrocarbons and hydrogen is then passed through line 21 into the second hydrocracking reaction zone 22. The second reaction zone may also comprise two or more separate reactors, and like the first reaction zone will have intermediate quench streams of hydrogen passed into the hydrocracking zone for purposes of temperature control. Like the effluent of the first reaction zone, the effluent stream of the second reaction zone carried by line 8 will contain a very broad range of compounds including hydrogen, hydrogen sulfide, ammonia, a full range of by-product and product hydrocarbons and some unconverted feed hydrocarbons.

Suitable feedstocks for the subject process include virtually any heavy hydrocarbonaceous mineral or synthetic oil or a mixture of one or more fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° Celsius (500° F.)and does not contain an appreciable concentration of asphaltenes. The feed stream should have a boiling point range falling between 260–538° C. Preferred first stage feedstocks therefore include gas oils having at least 50% volume of their components boiling above 371° C. (700° F.). The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %.

The product distribution of the subject process is set by the feed composition and the selectivity of the catalyst(s) at the conversion rate maintained in the reaction zones at the chosen operating conditions. The subject process is especially useful in the production of middle distillate fractions boiling in the range of about 300–700° F. (149–371° C.) as determined by the appropriate ASTM test procedure. These are recovered by fractionating the liquids recovered from the effluent of the reaction zone. The term "middle distillate" is intended to include the diesel, jet fuel and kerosene boiling range fractions. The terms "kerosene" and "jet fuel boiling point range" are intended to refer to about 300–550° F. (149–288° C.) and diesel boiling range is intended to refer to hydrocarbon boiling points of about 338–about 700° F. (170–371° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699-83 for further details on kerosene and diesel fuel properties and to D-1655 for aviation turbine feed.

Hydrocracking conditions employed in the subject process are those customarily employed in the art for hydrocracking. Hydrocracking reaction temperatures are in the broad range of 400° to 1200° F. (204–649° C.), preferably between 600° and 950° F. (316–510° C.). Reaction pressures are preferably between about 1000 and about 3000 psi (13,780–24,130 kPa). A temperature above about 316° C. and a total pressure above about 8270 kPa (1200 psi) are highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 2,000 and 30,000 scf per barrel of charge (355–5,333 std. $m^3/m^3$).

Suitable catalysts for use in all reaction zones of this process are available commercially from a number of vendors including UOP, Haldor-Topsoe and Criterion Catalyst Company. It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix may comprise any known refractory inorganic oxide such as alumina, magnesia, silica, titania, zirconia, silica-alumina and the like and preferably comprises a combination thereof such as alumina and silica-alumina. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites produced by UOP of Des Plaines, Ill. under the trademarks Y-82, Y-84, LZ-10 and LZ-20 are suitable zeolitic starting materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

The silica-alumina component of the hydrocracking or hydrotreating catalyst may be produced by any of the numerous techniques which are well described in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area, pore diameter and pore volume, may be developed to specified limits by any suitable means including aging a hydrosol and/or hydrogel under controlled acidic or basic conditions at ambient or elevated temperature.

An alumina component of the catalysts may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished catalysts for utilization in the subject process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

The composition and physical characteristics of the catalysts such as shape and surface area are not considered to be limiting upon the utilization of the present invention. Both catalysts may, for example, exist in the form of pills, pellets, granules, broken fragments, spheres, or various special shapes such as trilobal extrudates, disposed as a fixed bed within a reaction zone. Alternatively, the hydrocracking catalyst may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The catalyst particles may be prepared by any known method in the art including the well-known oil drop and extrusion methods.

A preferred form for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand further handling and subsequent calcination. Extrudability is determined from an analysis of the moisture content of the dough, with a moisture content in the range of from 30 to 50 wt. % being preferred. The dough then is extruded through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50–200° C. and subjected to a calcination procedure at a temperature of about 450–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to the catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and, 4,695,368 which are incorporated herein by reference.

Hydrogenation components contemplated for use in the catalysts are those catalytically active components selected from the Group VIB and Group VIII metals and their compounds. References herein to Groups of the Periodic Table are to the traditionally American form as reproduced in the fourth edition of *Chemical Engineer's Handbook.* J. H. Perry editor, McGraw-Hill, 1963. Generally, the amount of hydrogenation components present in the final catalyst composition is small compared to the quantity of the other above-mentioned support components. The Group VIII component generally comprises about 0.1 to about 30% by weight, preferably about 1 to about 20% by weight of the final catalytic composite calculated on an elemental basis. The Group VIB component of the hydrocracking catalyst comprises about 0.05 to about 30% by weight, preferably about 0.5 to about 20% by weight of the final catalytic composite calculated on an elemental basis. The total amount of Group VIII metal and Group VIB metal in the finished catalyst in the hydrocracking catalyst is preferably less than 21 wt. percent. The hydrogenation components contemplated for inclusion in the catalyst include one or more metals chosen from the group consisting of molybdenum, tungsten, chromium, iron, cobalt, nickel, platinum, palladium, iridium, osmium, rhodium, ruthenium and mixtures thereof. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrotreating catalyst. Usually phosphorus is present in the catalyst in the range of 1 to 30 wt. % and preferably 3 to 15 wt. % calculated as $P_2O_5$.

As previously mentioned, the Drawing illustrates an alternative embodiment of the invention in which a small separate bed of conventional hydrotreating catalyst is used to hydrotreat the vapor-phase stream recovered in the initial separation of the combined reactor effluent streams. This hydrotreating will be very effective due to the relatively high hydrogen concentration and the low concentration of heavy product and unconverted feed hydrocarbons. This hydrotreating step removes hetero atoms, e.g., sulfur from the hydrocarbons. One beneficial result is a reduction in the mercaptan content of the naphtha fraction recovered from column 13 without the provision of a separate bed of hydrotreating catalyst in the bottom of the hydrocracking reactor as described in previously cited U.S. Pat. No. 3,338,819.

The location of this hydrotreating step is not critical and it may be performed in either the initial high pressure separator 10 or in a separate reactor 17. In either event the vapor is somewhat cooler than the effluent of the hydrocracking catalyst, which significantly helps promote the hydrogenation reaction. This lower temperature is the result of intermediate heat exchange to recover heat. The hydrotreating reaction is preferably performed at a temperature of about 500–550° F. and a liquid hourly space velocity of at least 10 $hr^{-1}$ using a catalyst comprising molybdenum or tungsten and nickel or cobalt on a porous alumina support. Performing the hydrotreating in this manner eliminates any need to place a separate bed of hydrotreating catalyst in the bottom of each reactor 6 and 22 and therefore also conserve space in these reactors. This deletion of the hydrotreating catalyst from the hydrocracking reactors also removes the need for either the addition of quench or indirect heat exchange to cool the effluent of the hydrocracking catalyst prior to hydrotreatment, which also provides additional space within the hydrocracking reactor.

This alternative embodiment of the invention may be characterized as a hydrocracking process which comprises the steps of heating a hydrocarbonaceous process feed stream by indirect heat exchange against the combined flow of the hereinafter defined first and second reaction zones; dividing the process feed stream into a first feed stream and a second feed stream of equal composition, passing the first feed stream into a first hydrocracking reaction zone in admixture with hydrogen, contacting the first feed stream with a first bed of hydrocracking catalyst maintained at hydrocracking conditions which achieve a conversion rate between about 50 and about 85 volume percent and producing a first effluent stream; passing the second feed stream into a second hydrocracking reaction zone in admixture with hydrogen and contacting the second feed stream with a second bed of hydrocracking catalyst maintained at hydrocracking conditions which achieve a conversion rate above 40 percent and producing a second effluent stream; passing the first and second effluent streams into a common vapor-liquid separation zone, and removing a vapor phase process stream and a liquid phase process stream from the vapor-liquid separation zone; contacting the vapor phase process stream with a hydrotreating catalyst; recycling hydrogen contained in the vapor phase process steam to both the first and second hydrocracking reaction zones; passing the liquid phase process stream into a fractionation zone, and recovering a diesel boiling range product stream and a hydrocarbon recycle stream comprising unconverted hydrocarbons; and, passing the hydrocarbon recycle stream into the second hydrocracking reaction zone.

What is claimed:

1. A hydrocracking process which comprises the steps of:

a.) dividing a hydrocarbon feed stream into a first feed stream and a second feed stream of equal composition, and contacting the first feed stream and hydrogen with a first bed of hydrocracking catalyst maintained at hydrocracking conditions in a first hydrocracking reaction zone;

b.) contacting the second feed stream, in admixture with hydrogen, with a second bed of hydrocracking catalyst maintained at hydrocracking conditions in a second hydrocracking reaction zone;

c.) passing the effluent of the first hydrocracking reaction zone and the effluent of the second hydrocracking reaction zone into a vapor-liquid separation zone, and removing a vapor phase process stream and a liquid phase process stream from the vapor-liquid separation zone;

d.) recycling at least a portion of the vapor phase process stream directly to each of the first and second hydrocracking reaction zones;

e.) passing the liquid phase process stream into a fractionation zone, and recovering a distillate boiling range product stream and a hydrocarbon recycle stream comprising unconverted hydrocarbons; and, f.) passing substantially all of the hydrocarbon recycle stream into the second hydrocracking reaction zone.

2. The process of claim 1 wherein the same hydrocracking catalyst is present in the first and the second beds of hydrocracking catalyst.

3. The process of claim 1 wherein a different catalyst is present in the second bed of hydrocracking catalyst than is present in the first bed of hydrocracking catalyst.

4. The process of claim 1 wherein the conversion rate in both the first and the second hydrocracking reaction zones is between 40 and 85 volume percent.

5. A hydrocracking process which comprises the steps of:

a.) dividing a hydrocarbon feed stream into a first feed stream and a second feed stream, and passing the first feed stream into a first hydrocracking reaction zone in admixture with hydrogen and contacting the first feed stream with a first bed of hydrocracking catalyst maintained at hydrocracking conditions which achieve a conversion rate above 40 percent and producing a first effluent stream;

b.) contacting the second feed stream in admixture with hydrogen with a second bed of hydrocracking catalyst in a second hydrocracking reaction zone maintained at hydrocracking conditions which achieve a conversion rate above 40 percent and producing a second effluent stream;

c.) passing the first and second effluent streams into a common vapor-liquid separation zone, and removing a vapor phase process stream and a liquid phase process stream from the vapor-liquid separation zone;

d.) recycling at least a portion of the vapor phase process stream to the first and second hydrocracking reaction zones;

e.) passing the liquid phase process stream into a fractionation zone, and recovering a diesel boiling range product stream and a hydrocarbon recycle stream comprising unconverted hydrocarbons; and, f.) passing substantially all of the hydrocarbon recycle stream into the second hydrocracking reaction zone.

6. The process of claim 5 wherein both the first and second hydrocracking reaction zones are operated at conditions which effect a conversion rate between 50 and 85 volume percent.

7. The process of claim 6 where the conversion rate in both the first and second reaction zone is above 60 percent.

8. A hydrocracking process which comprises the steps of:

a.) dividing a process feed stream into a first feed stream and a second feed stream of equal composition, passing the first feed stream into a first hydrocracking reaction zone in admixture with hydrogen, contacting the first feed stream with a first bed of hydrocracking catalyst maintained at hydrocracking conditions which achieve a conversion rate between 50 and 85 volume percent and producing a first effluent stream;

b.) passing the second feed stream into a second hydrocracking reaction zone in admixture with hydrogen and contacting the second feed stream with a second bed of hydrocracking catalyst maintained at hydrocracking conditions which achieve a conversion rate above 40 percent and producing a second effluent stream;

c.) passing the first and second effluent streams into a common vapor-liquid separation zone, and removing a vapor phase process stream and a liquid phase process stream from the vapor-liquid separation zone;

d.) contacting the vapor phase process stream with a hydrotreating catalyst;

e.) recycling hydrogen contained in the vapor phase process stream to both the first and second hydrocracking reaction zones;

f.) passing the liquid phase process stream into a fractionation zone, and recovering a diesel boiling range product stream and a hydrocarbon recycle stream comprising unconverted hydrocarbons; and, g.) passing the hydrocarbon recycle stream into only the second hydrocracking reaction zone.

9. The process of claim 8 wherein prior to performing step (a) the process feed stream is heated by indirect heat exchange against the combined flow of the effluent streams of the first and second reaction zones and then further heated in a fired heater.

* * * * *